US012544824B2

(12) United States Patent
Saunders, Jr. et al.

(10) Patent No.: US 12,544,824 B2
(45) Date of Patent: Feb. 10, 2026

(54) SENSING ARRANGEMENT AND SYSTEM FOR DYNAMIC MEASUREMENTS OF CAN ON PUNCH AND CAN BODYMAKER INCLUDING SAME

(71) Applicant: Stolle Machinery Company, LLC, Centennial, CO (US)

(72) Inventors: Jonathan Scott Saunders, Jr., Englewood, CO (US); Ian Kenneth Scholey, Barnsley (GB)

(73) Assignee: Stolle Machinery Company, LLC, Centennial, CO (US)

( * ) Notice: Subject to any disclaimer, the term of this patent is extended or adjusted under 35 U.S.C. 154(b) by 135 days.

(21) Appl. No.: 18/121,273

(22) Filed: Mar. 14, 2023

(65) Prior Publication Data

US 2023/0294159 A1 Sep. 21, 2023

Related U.S. Application Data

(60) Provisional application No. 63/319,943, filed on Mar. 15, 2022.

(51) Int. Cl.

| | |
|---|---|
| ***B21D 51/26*** | (2006.01) |
| ***B21D 22/28*** | (2006.01) |
| ***B21D 43/00*** | (2006.01) |
| ***B21D 45/08*** | (2006.01) |

(52) U.S. Cl.

CPC ..... *B21D 51/2692* (2013.01); *B21D 22/283* (2013.01); *B21D 43/003* (2013.01); *B21D 45/08* (2013.01)

(58) Field of Classification Search

CPC .... B21D 45/08; B21D 45/003; B21D 22/283; B21D 51/2692

See application file for complete search history.

(56) References Cited

U.S. PATENT DOCUMENTS

| | | | |
|---|---|---|---|
| 3,771,345 | A | 11/1973 | Paramonoff |
| 5,272,902 | A | 12/1993 | Kobak |
| 7,124,613 | B1 | 10/2006 | McClung |
| 8,713,980 | B2 | 5/2014 | Fleischer et al. |
| 8,869,578 | B2 | 10/2014 | Fleischer et al. |

(Continued)

FOREIGN PATENT DOCUMENTS

| | | |
|---|---|---|
| BR | 1220200209356 | 5/2012 |
| BR | 1120130306793 | 3/2021 |

(Continued)

OTHER PUBLICATIONS

Delta-H Technology Ltd., Free Stroke Analyser, User Manual. Evid. 3, four pages.

(Continued)

*Primary Examiner* — Teresa M Ekiert

(74) *Attorney, Agent, or Firm* — Eckert Seamans Cherin & Mellott, LLC

(57) ABSTRACT

A sensing arrangement for use in a can bodymaker includes a plurality of sensors positioned around, and spaced a radial distance from, a sensing axis. Each sensor of the plurality of sensors is structured to determine a number of characteristics of a can body positioned on a punch of the can bodymaker as the punch passes along the sensing axis during normal operation of the bodymaker producing can bodies.

14 Claims, 3 Drawing Sheets

(56) References Cited

U.S. PATENT DOCUMENTS

| | | | | |
|---|---|---|---|---|
| 8,869,579 | B2 | 10/2014 | Bray et al. | |
| 9,079,237 | B2 | 7/2015 | Fleischer et al. | |
| 10,434,558 | B2 | 10/2019 | Sines | |
| 2006/0225479 | A1 | 10/2006 | Zauhar | |
| 2016/0263613 | A1 | 9/2016 | Lin | |
| 2016/0263643 | A1* | 9/2016 | Fowler | B21D 22/286 |
| 2019/0240717 | A1 | 8/2019 | Rukat | |

FOREIGN PATENT DOCUMENTS

| | | | |
|---|---|---|---|
| CN | ZL201280032478.1 | | 12/2016 |
| CN | ZL201611024978.7 | | 11/2019 |
| EP | 3061541 | | 12/2019 |
| EP | 3603844 | A1 | 2/2020 |
| JP | 5872688 | | 1/2016 |
| JP | 6263560 | | 12/2019 |
| WO | 2008068169 | A1 | 6/2008 |
| WO | 2012166331 | A1 | 12/2012 |

OTHER PUBLICATIONS

Delta-H Technology Ltd., Version 2.09, Free Stroke Analyser, User Manual, Evid. 2, Sep. 23, 2014, 38 pages.

Delta-H Technology Ltd., Free Stroke Analyser—Software and Gauge Equipment for the Measurement of Bodymaker Alighment, 2006, two pages.

CTDA Technology vs. Free Stroke Analyser, three pages.

International Searching Authority, U.S. Patent and Trademark Office, PCT Application No. PCT/US23/64303, International Search Report and Written Opinion, Aug. 10, 2023, 16 pages.

* cited by examiner

SENSING ARRANGEMENT AND SYSTEM FOR DYNAMIC MEASUREMENTS OF CAN ON PUNCH AND CAN BODYMAKER INCLUDING SAME

CROSS REFERENCE TO RELATED APPLICATIONS

This application claims priority to U.S. Patent Application Ser. No. 63/319,943, filed Mar. 15, 2022.

FIELD OF THE INVENTION

The disclosed concept relates generally to machinery and, more particularly, to can bodymakers for producing can bodies such as used in the food and beverage packaging industries. More particularly, the disclosed concept relates to sensing arrangements and system for use in can bodymakers for dynamically measuring characteristics of can bodies being formed on a punch as well as the active positioning of the punch relative to components within the bodymaker.

BACKGROUND OF THE INVENTION

Generally, an aluminum can begins as a sheet of aluminum from which a circular blank is cut. The blank is formed into a "cup" having a bottom and a depending sidewall. The cup is fed into a can bodymaker which passes the cup through additional circular dies that thin and elongate the cup, thus forming a can body. That is, the cup is disposed on a punch mounted on an elongated ram. The ram is structured to reciprocate and pass the cup through the circular dies which (re)draw and iron the cup. That is, on each forward stroke of the ram, a cup is passed through the circular dies which further form the cup into the can body. Near the start of the return stroke, the now elongated can body is removed from the ram prior to the punch passing back through the circular dies. A new cup is disposed on the punch prior to the punch passing forward again through the circular dies. Following additional finishing operations, e.g. trimming, washing, printing, etc., each can body is sent to a filler which fills the can with product. A top is then coupled to, and sealed against, the can body, thereby completing the can.

The tool pack in the can bodymaker has multiple, spaced dies, each die having a substantially circular opening. Each die opening is slightly smaller than the next adjacent upstream die. Thus, when the punch draws the cup through the first die, the redraw die, the aluminum cup is deformed over the substantially cylindrical punch. Because the openings in the subsequent downstream dies of the tool pack have smaller inner diameters, i.e. smaller openings, the aluminum cup is thinned as the ram moves the punch and aluminum cup thereon through the rest of the dies of the tool pack. The space between the ram and the redraw die is typically less than about 0.010 inch and less than about 0.004 inch in the last ironing die. After the cup has moved through the last die, the cup bottom and sidewall have the desired thickness; the only other deformation required is to shape the bottom of the cup into an inwardly extending (i.e., concave) dome. To accomplish this, the distal end of the punch is concave while at the maximum extension of the ram is a "domer." The domer has a generally convex dome and a shaped perimeter. As the ram reaches its maximum extension, the bottom of the can body engages the domer and is deformed into a dome and the bottom perimeter of the can body is shaped as desired (typically angled inwardly so as to increase the strength of the can body and to allow for the resulting cans to be stacked). As the ram withdraws, the can body the is stripped off of the end of the punch by injecting air into the center of the ram. The air travels through the ram and exits out of the end of the punch and breaks the can body loose from the punch. Typically, there is also a mechanical stripper, which prevents the can body from staying on the punch as it retracts back through the tool pack. The ram is withdrawn through the tool pack, a new cup is deposited on the punch, and the cycle repeats.

The ram and the tool pack are typically oriented generally horizontally. This orientation, however, allows for wear and tear on the ram. That is, the dies in the tool pack must be separated so as to allow for the proper deformation of the blank/cup. This means that the ram must extend horizontally through the entire tool pack, a distance that is typically between 18 and 30 inches, with the stroke length for the body-maker being slightly larger. This means that the ram is, essentially, a cantilevered arm. As is known, even a very rigid member supported as a cantilever will droop at the distal end. While this droop is generally not a problem for stationary members, the droop is a problem for a reciprocating punch/ram passing through a number of dies with a radial clearance of less than about 0.004 inch. In order to compensate for the droop of the punch/ram, the tool pack, domer and stripper are typically each statically aligned to the punch/ram. However such static alignment(s) may not be correct for the dynamics of the moving ram/punch when the machine is in operation. Also, there are other factors that can cause the punch not to run concentrically to the machine center line. Thus, because of the droop and other reasons, the ram may not be concentric with the circular dies of the tool pack, i.e., the ram is closer to, or in contact with, the lower portion of the die thus causing mis-formed, un-useable can bodies and over time premature wear and/or other damage to one or both of the punch and/or the dies of the tool pack. When this happens, the worn/damaged parts must be replaced. Further, because replacement of such parts is a time consuming procedure, and because a typical can bodymaker produces over 15,000 cans an hour, having a misaligned punch/ram is a disadvantage. That is, if the punch/ram is misaligned, it is unlikely that any acceptable cans will be made. The ram should be aligned to the centerline of the machine (horizontally and vertically).

In order to verify that acceptable cans are being formed, the can bodymaker is periodically stopped so that measurements of specific can bodies can be carried out, particularly the thicknesses thereof around the circumference of several can bodies. From such measurements determinations of adjustments needed and/or the need for replacement of worn parts can be made. Such adjustments and/or part replacement(s) are then carried out and the machine is placed back into operation. The time needed for carrying out such stoppage(s) for measuring cans and adjusting the alignment of, or replacing, components of the bodymaker is time the bodymaker is not producing cans for use and thus is a disadvantage. Thus, a stated problem with the known systems and methods for aligning a punch/ram with a tool pack and/or other components of a can bodymaker is that the known systems and methods do not detect the position of the punch/ram in motion and/or details of the can body formed thereon from the passing of the punch through the tool pack.

SUMMARY OF THE INVENTION

The disclosed and claimed concept provides sensing systems and arrangements that determine the position of a punch and can body thereon as the punch and the can body exit a tool pack on a reciprocating punch of a can bodymaker during normal can body forming operations. The arrangement provides for characteristics of the can body to be determined while the can bodymaker is in normal operation without needing to stop or slow the machine. The dynamic readings provide for active feedback that can be readily employed for automatically positioning/aligning components of the can bodymaker as needed while the bodymaker is actively forming can bodies without needing to stop or slow the machine.

As one aspect of the disclosed concept, a sensing arrangement for use in a can bodymaker is provided. The sensing arrangement comprises: a plurality of sensors positioned around, and spaced a radial distance from, a sensing axis, wherein each sensor of the plurality of sensors is structured to determine a number of characteristics of one or more of a can body positioned on a punch of the can bodymaker and/or of the punch as the punch passes along the sensing axis during normal operation of the can bodymaker producing can bodies.

The number of characteristics may comprise the presence of the can body on the punch.

The number of characteristics may comprise the positioning of the surface of the can body and the surface of the punch The plurality of sensors may comprise at least three sensors. The plurality of sensors may comprise at least four sensors.

The sensing arrangement may further comprise a frame, wherein the plurality of sensors are coupled to the frame and wherein the frame is structured to be coupled to a stripper bulkhead of the can bodymaker.

As another aspect of the disclosed concept, a system for sensing characteristics of a can body in a can bodymaker is provided. The system comprises: a sensing arrangement comprising: a plurality of sensors positioned around and spaced a radial distance from a sensing axis, wherein each sensor of the plurality of sensors is structured to determine a number of characteristics of one or more of a can body positioned on a punch of the can body-maker and/or the punch as the punch passes along the sensing axis during normal operation of the bodymaker producing can bodies; and a controller in communication with the plurality of sensors.

The controller may be structured to determine the presence of the can body on the punch from the number of characteristics. The controller may be structured to determine a thickness of the can body from the number of characteristics. The controller may be structured to determine the positioning of the punch with respect to the sensing axis.

The plurality of sensors may comprise at least three sensors.

The sensing arrangement may further comprise a frame, wherein the plurality of sensors are coupled to the frame, and wherein the frame is structured to be coupled to a stripper bulkhead of the can bodymaker.

The controller may be structured to determine adjustments to a position of a component of the can bodymaker responsive to the number of characteristics of the can body. The system may further comprise an adjustment arrangement structured to adjust the position of the component, wherein the adjustment arrangement is in communication with, and controlled by the controller.

As yet another aspect of the disclosed concept, a can bodymaker for forming a plurality of can bodies is provided. The can bodymaker comprises: a tool pack having a forming passage defined therethrough about a central forming axis by a plurality of forming dies structured to form a can body from a cup; a ram body having a punch positioned on and end of the ram body and structured to move back and forth through the forming passage in a reciprocating manner, the ram body punch structured to receive the cup and pass the cup through the plurality of forming dies of the tool pack to form the can body; a stripper mechanism structured to remove the can body from the punch after passing through the tool pack; and a sensing arrangement positioned between the tool pack and the stripper mechanism, the sensing arrangement comprising: a plurality of sensors positioned around, and spaced a radial distance from, a sensing axis positioned generally along the forming axis, wherein each sensor of the plurality of sensors is structured to determine a number of characteristics of the can body positioned on the ram as the can body passes therethrough on the ram body prior to the stripper mechanism.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are provided for the purpose of illustration and description only and are not intended as a definition of the limits of the concept.

BRIEF DESCRIPTION OF THE DRAWINGS

A full understanding of the disclosed concept can be gained from the following description of the preferred embodiments when read in conjunction with the accompanying drawings in which.

DETAILED DESCRIPTION OF THE INVENTION

Figure 1:
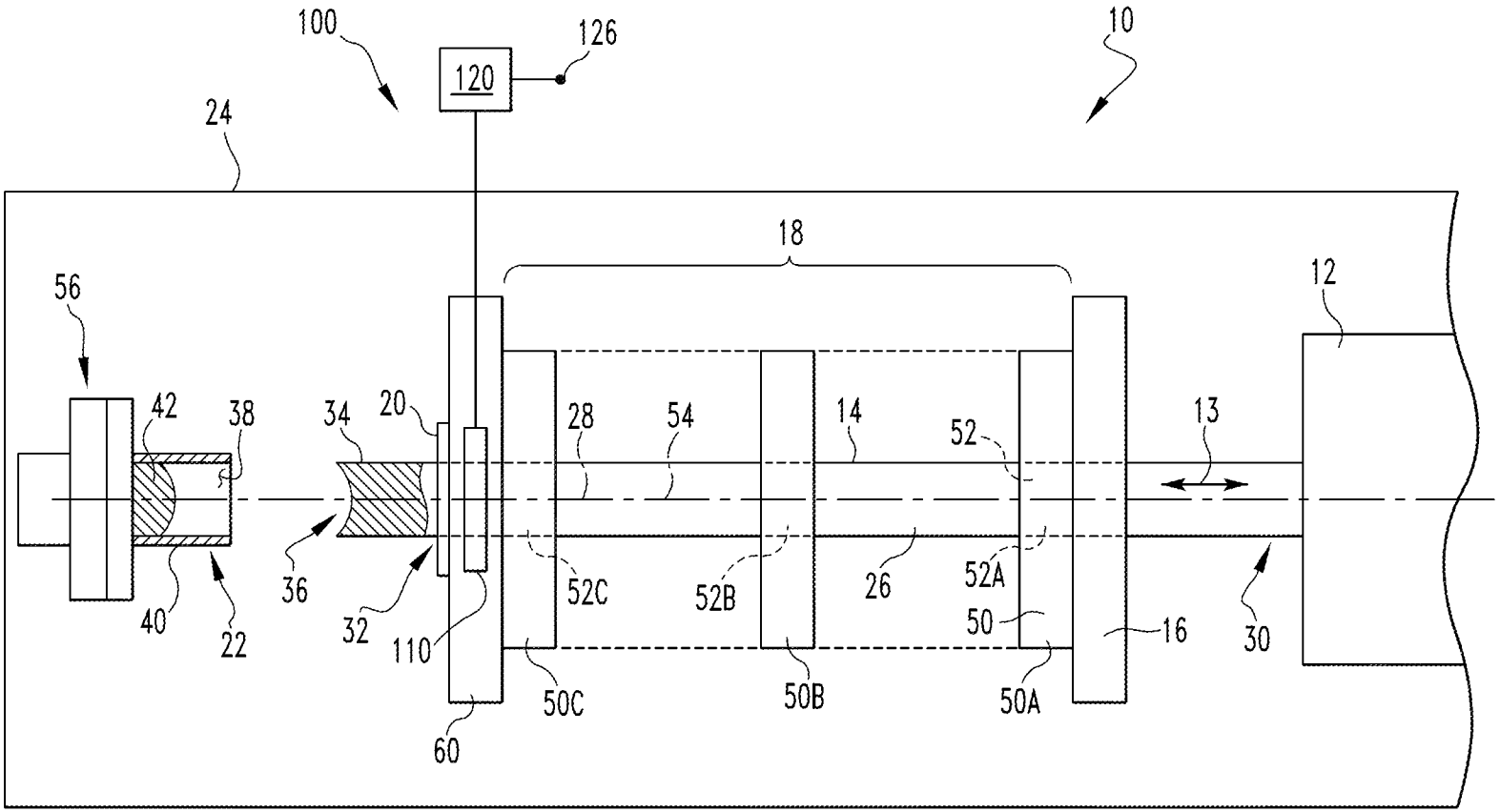
FIG. 1 is a schematic cross-sectional view of a can bodymaker in accordance with an example embodiment of the disclosed concept.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the term "can" refers to any known or suitable container, which is structured to contain a substance (e.g., without limitation, liquid, food, any other suitable substance), and expressly includes, but is not limited to, beverage cans, such as beer and soda cans, as well as cans used for food.

As used herein, a "target position" is a selected position for a component relative to one or more other component(s).

As used herein, "dynamically positioning" means positioning a component relative to one or more other component(s) based on measurements acquired when the punch of a can forming machine is in motion. This would include adjusting the component while the punch is in motion as well as when the punch is motionless, so long as the measurements are acquired when the punch is in motion.

As used herein, "actively positioning" means positioning a component relative to one or more other component(s) when the punch is in motion.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are coupled in direct contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, "engage," when used in reference to gears or other components having teeth, means that the teeth of the gears interface with each other and the rotation of one gear causes the other gear to rotate as well.

As employed herein, the term "number" shall mean one or an integer greater than one (i.e., a plurality).

As used herein, "normal operation" of a bodymaker shall mean operating the bodymaker in a full production mode over an extended period of time with the intention of producing an optimum volume of can bodies for the particular bodymaker over such time.

Referring now to FIG. 1, a representative portion of can forming machine, or can bodymaker 10, in accordance with an example embodiment of the disclosed concept is shown schematically. The can bodymaker 10 includes an operating mechanism 12 structured to provide a cyclical and/or reciprocating motion (such as shown by the double-headed arrow 13), a ram 14, a load station 16, a die assembly, or tool pack, 18, a can stripper 20, and a domer assembly 22. In the example embodiment shown in FIG. 1, each of the aforementioned components are coupled, directly or indirectly, to a frame, or housing (shown generally as 24), for maintaining such components, and/or selected portions thereof, in a known relationship with respect to one or more of the other of such components.

Continuing to refer to FIG. 1, the ram 14 has an elongated, substantially cylindrical ram body 26 positioned about a longitudinal axis 28 such that ram 14 moves back and forth generally along the longitudinal axis 28. The ram body 26 includes a proximal end 30 positioned nearest, and coupled to, the operating mechanism 12, and a distal end 32 positioned opposite the proximal end 30. A punch 34 is disposed at, over, or on the distal end 32 of the ram 14. The punch 34 is a generally cylindrical body with a concave distal end 36 which may be shaped to correspond to a cavity 38 of a domer die 40 of the domer assembly 22. The operating mechanism 12 provides a reciprocal motion to the ram body 26 causing the ram body 26, and therefore the punch 34 positioned at the distal end 32 of the ram body 26, to move back and forth along the longitudinal axis 28. That is, the punch 34 is structured to reciprocate between a retracted position, wherein the punch 34 is positioned between the load station 16 and the operating mechanism 12, and an extended position, wherein the ram body extends generally horizontally through the tool pack 18 and the distal end 36 of the punch 34 is disposed adjacent to the domer die 40. More particularly, in the extended position, the distal end 36 of the punch 34 extends into the cavity 38 of the domer die 40 of the domer assembly 22 and is indirectly engaged with a convex dome formation 42 provided as a portion of the darner die 40.

The tool pack 18 includes a number (three as shown) of die(s) 50 (each) having an opening 52 therein. The opening 52A in the first die 50A (the die 50 closest to the operating mechanism 12) is slightly larger than the opening 52B in the second (middle, as shown) die 50B. The opening 52B in the second die 50B is slightly larger than the opening 52C in the third (farthest from the operating mechanism 12) die 50C. That is, in one example embodiment, the opening 52A in the first die 50A has a radius that is about 0.010 inch larger than the radius of the punch 34, the opening 52B in the second die 50B has a radius that is about 0.007 inch larger than the radius of the punch 34, and the opening 52C in the third die 50C has a radius that is about 0.004 inch larger than the radius of the punch 34. The opening(s) 52 of the die(s) 50 are disposed along a common axis 54 and collectively generally form a forming passage (not numbered) that is thus disposed about the common axis 54. In order to best form a can body, ideally the common axis 54 of the forming passage is generally aligned with the longitudinal axis 28 of the ram body 26 (and vice versa) such that the ram body 26 and the punch 34 on the end thereof pass concentrically through the opening 52 of each of the dies 50 during a can forming operation.

In the configuration shown in FIG. 1, the can bodymaker 10 is structured to transform a cup into a can body, which may have a top added, forming a can. A cup is disposed on/over the punch 34 by the load station 16 prior to the punch 34 passing forward through the tool pack 18 moving from the retracted position to the extended position such as previously discussed. When the punch 34 pushes the cup through the tool pack 18, ideally the cup is thinned and stretched to a desired length and wall thickness if the opening(s) 52 of the die(s) 50 of the die pack 18 are properly aligned with the path of the punch 34 such as previously mentioned. The elongated cup is a can body.

The domer assembly 22 is disposed at the end of the stroke of the ram body 26. The domer assembly 22 includes the domer die 40 that is coupled to the frame 24 of the can bodymaker 10 by a mounting assembly 56 which may be of any suitable arrangement. In an example embodiment of the disclosed concept, the mounting assembly 56 is arranged in a manner similar to that disclosed in U.S. Pat. No. 8,713,980, the contents of which are incorporated herein by reference, such that the positioning of the domer die 40 can be dynamically adjusted (discussed below). The domer die 40 is a body 44 with the cavity 38 defining the convex dome formation 42. The cavity 38 may include other features structured to shape the bottom of the cup. Ideally, the center of the dome formation 42 is substantially aligned with the longitudinal axis 28 of the ram body 26. In such arrangement, when the ram body 26 is at its maximum extension, i.e., in the extended position previously discussed, the cup bottom, that portion of the cup covering the concave distal end 36 of the punch 34, is shaped by the punch 34 entering the cavity 38 of the domer die 40. That is, the cup bottom becomes a dome extending into the can body. After the dome is formed in the newly formed can body still positioned on the punch 34, the ram body 26 begins the rearward portion of the stroke from the extended position back toward the retracted position.

The can stripper 20 is disposed on the outer surface of a stripper bulkhead 60 opposite the tool pack 18. The can stripper 20 removes the can body from the punch 34 after the dome has been formed in the bottom of the can and the ram 14 (and thus the punch 34) has begun to move rearward. Thus, the punch 34 travels rearwardly with no cup or other material between the punch 34 and the dies 50 of the tool pack 18. In this configuration it is possible for the punch 34 to contact the dies 50 resulting in damage to the punch 34 and/or the dies 50. To prevent or reduce this damage, it is advantageous to have the longitudinal axis 28 of the ram body 26 and the die axis 54 substantially aligned. That is, the punch 34 should not be vibrating or drooping. As previously discussed, the punch 34, disposed on the distal end 32 of the ram body 26, is prone to drooping as it is a cantilever body. Further, if the dome 42 of the domer die 40 is misaligned with the longitudinal axis 28 of the ram body 26, the punch 34 may be pushed out of alignment with the die axis 54 upon entering the cavity 38 of the domer die 40 and then rapidly returned, i.e. snapped, into alignment when leaving the cavity 38. This action may cause the punch 34 to vibrate. While both the amount of droop and the misalignment caused by vibration are small, the tolerances between the punch 34 and the openings 52 of each die 50 of the tool pack 18 are sufficiently small so that any droop or vibration may cause contact between the punch 34 and the opening(s) 52.

Figure 2:
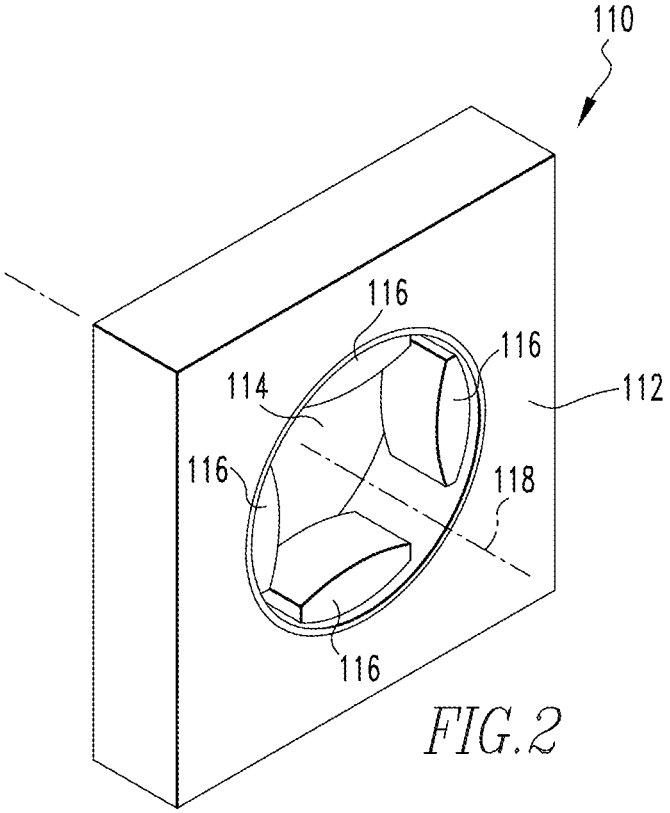
FIG. 2 is a partially schematic perspective view of a sensing arrangement in accordance with an example embodiment of the disclosed concept.
Figure 3:
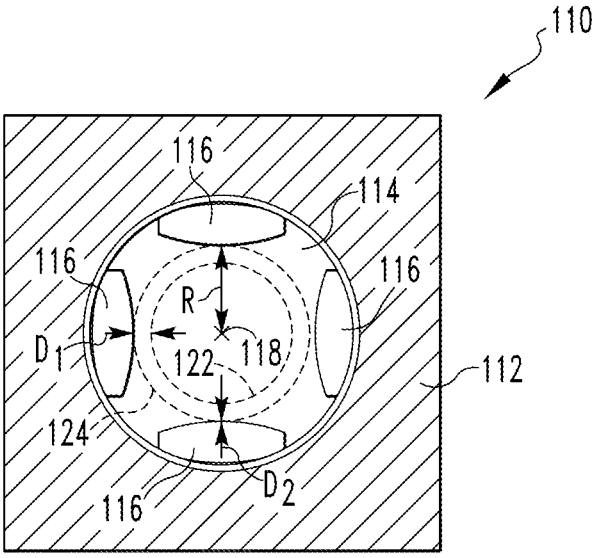
FIG. 3 is a partially schematic front elevation view of the sensing arrangement of FIG. 2.

Continuing to refer to FIG. 1, and additionally to FIGS. 2 and 3, the can bodymaker 10 further includes a sensing system 100 having a sensing arrangement 110 for carrying out dynamic measurements of the positioning of the punch 34 as well as measurements of the can body being formed on the punch 34 while the can bodymaker 10 is in normal operation. As shown in FIG. 1, the sensing arrangement 110 is positioned on or in, and coupled to, the stripper bulkhead 60 between the tool pack 18 and the can stripper 20. As shown in FIGS. 2 and 3, the sensing arrangement 110 includes a frame 112 positioned about an opening 114 through which the punch 34 and the overlying can body can freely pass. The sensing arrangement 110 further includes a plurality of sensors 116 coupled to the frame 112 about a sensing axis 118 passing through the opening 114. In the example embodiment shown in FIGS. 1-3, the sensing arrangement 110 includes four sensors 116 of generally identical construction, each spaced a distance R (FIG. 3) from the sensing axis 118 and positioned at 90° increments about the sensing axis 118. In an example embodiment, each sensor 116 is spaced a distance R from the sensing axis 118 of 0.030" more than the intended radius of a can body on the punch 34. While four sensors 116 are shown, it is to be appreciated that arrangements utilizing other quantities of sensors 116 (e.g., without limitation, three sensors 116, more than four sensors 116, etc.) may be employed without varying from the scope of the disclosed concept. Each sensor 116 is structured to provide a signal to a controller 120 (of any suitable arrangement, provided as a component of the sensing system 100) from which a number of characteristics of the punch 34 as well as a can body positioned on the punch 34 (as the punch 34 and can body pass through the opening 114 after passing through the tool pack 18) can be determined. Such characteristics include: the position of the punch 34 relative to each of the sensors 116, the presence (or absence) of the can body, the length of the can body present on the punch 34, and the thickness of the can body (including variations thereof along the height of the can body, and/or about a circumference of the can body when multiple sensors are considered). In an example embodiment of the disclosed concept, each sensor 116 stores a series of collected samples and then passes the data over a determined protocol at a prescribed transfer rate, via wired or bluetooth networks, while in communication with the controller 120.

In an example embodiment of the disclosed concept, each respective sensor 116 is an inductive proximity sensor that is structured to provide output signals to the controller 120 proportional to the distance D1 to the surface 122 (shown in dashed line in FIG. 3) of the punch 34 from the respective sensor 116 and/or the distance D2 to the surface 124 (shown in dashed line in FIG. 3) of the can body (not numbered) from the respective sensor 116. In some example embodiments of the disclosed concept, the distance D1 is defined by the specifications set forth in the quality standards edict, often ranging between 0.0065" to 0.0040" and as small as 0.038"; where the distance D2, having a safety distance between the OD wall of the container/punch and the physical sensing coil representing the clearance ranging from approximately 0.080" to 0.030" depending on the container wall thickness as defined by the quality standards.

Figure 4:
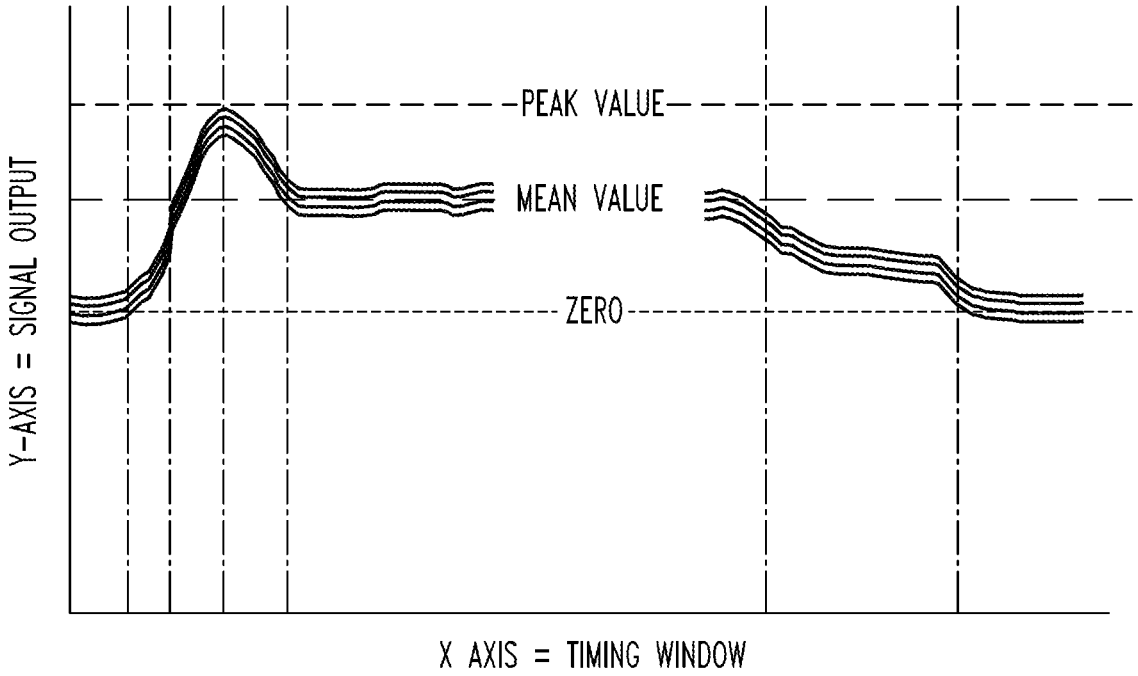
FIG. 4 is a series of graphs showing example output signals from the sensors of a sensing arrangement such as shown in FIGS. 2 and 3 when employed in a can bodymaker such as shown in FIG. 1 actively forming/producing can bodies.

FIG. 4 illustrates an example of a series of graphs showing example output signals produced by the four sensors 116 of the sensing arrangement 110 (such as shown in FIGS. 2 and 3) when the sensing arrangement 110 is employed in the can bodymaker 10 such as shown in FIG. 1 while the can bodymaker 10 is actively forming/producing a can body. Each waveform in the graph represents one complete cycle or stroke as the target (i.e., the punch 34 and container/can body disposed thereon) passes through the sensing arrangement 110. Variations in the output signal are interpreted in the algorithms of the controller 120 and provide details related to the ironing or forming of the container (i.e., the can body). Such interpretations include, but are not limited to, ram temperature, ram velocity, entry/exit angle, position relative to calculated center, container wall thickness and variations along the body of the container. Additionally, these wave forms provide the target position derived from the known position(s) of the sensor(s) 116.

The controller 120 of sensing system 100, shown schematically in FIG. 1, utilizes a programmable logic circuit (PLC) and stored algorithm(s) to analyze the signals from the sensors 116 to provide output 126. The output 126 may simply be provided (e.g., via any suitable wired or wireless arrangement) to a user as a report (e.g., on a suitable display or other arrangement) providing details of can bodies and/or information regarding positioning of the punch 34. The output 126 may be provided to, and utilized by, other systems and or arrangements to control/adjust operation of the bodymaker 10 and/or to control/adjust components thereof. Although shown as a stand-alone component, it is to be appreciated that the controller 120 may be a control device employed for other operations related to the bodymaker 10, or other device(s)/arrangement(s) without varying from the scope of the disclosed concept.

From the foregoing it is thus to be appreciated that the disclosed concept provides for can body-makers that can be operated more autonomously than conventional arrangements and require less down time.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A system for sensing characteristics of a can body in a can bodymaker, the system comprising:

a sensing arrangement comprising:

a plurality of inductive proximity sensors positioned around and spaced a radial distance from a sensing axis; and a controller in communication with the plurality of sensors, wherein each sensor of the plurality of sensors is structured to provide a signal to the controller, wherein the controller is structured to determine a number of characteristics of a can body positioned on a punch of the can bodymaker as the punch passes along the sensing axis during normal operation of the bodymaker producing can bodies from the signals provided by the plurality of sensors, and wherein the number of characteristics comprises a variation of a thickness of the can body on the punch along the can body on the punch parallel to the sensing axis.

2. The system of claim 1, wherein the controller is structured to determine the presence of the can body on the punch from the number of characteristics.

3. The system of claim 1, wherein the controller is structured to determine a thickness of the can body from the number of characteristics.

4. The system of claim 1, wherein the controller is structured to determine the positioning of the punch with respect to the sensing axis.

5. The system of claim 1, wherein the plurality of sensors comprises at least three sensors.

6. The system of claim 1, wherein the sensing arrangement further comprises a frame, wherein the plurality of sensors are coupled to the frame, and wherein the frame is structured to be coupled to a stripper bulkhead of the can bodymaker.

7. The system of claim 1, wherein the controller is structured to determine adjustments to a position of a component of the can bodymaker responsive to the number of characteristics of the can body.

8. A can bodymaker for forming a plurality of can bodies, the can bodymaker comprising:

a tool pack having a forming passage defined therethrough about a central forming axis by a plurality of forming dies structured to form a can body from a cup;

a ram body having a punch positioned on and end of the ram body and structured to move back and forth through the forming passage in a reciprocating manner, the ram body punch structured to receive the cup and pass the cup through the plurality of forming dies of the tool pack to form the can body;

a stripper mechanism structured to remove the can body from the punch after passing through the tool pack; and a sensing arrangement positioned between the tool pack and the stripper mechanism, the sensing arrangement comprising:

a plurality of sensors positioned around, and spaced a radial distance from, a sensing axis positioned generally along the forming axis; and a controller in communication with the plurality of sensors, wherein each sensor of the plurality of sensors is structured to provide a signal to the controller, wherein the controller is structured to determine a number of characteristics of the can body positioned on the ram from the signals provided by the plurality of sensors as the can body passes therethrough on the ram body prior to the stripper mechanism, and wherein the number of characteristics comprises a variation of a thickness of the can body on the punch along the can body on the punch parallel to the sensing axis.

9. The can bodymaker of claim 8, wherein the controller is structured to determine the presence of the can body on the punch from the number of characteristics.

10. The can bodymaker of claim 8, wherein the controller is structured to determine a thickness of the can body from the number of characteristics.

11. The can bodymaker of claim 8, wherein the controller is structured to determine the positioning of the punch with respect to the sensing axis.

12. The can bodymaker of claim 8, wherein the plurality of sensors comprises at least three sensors.

13. The can bodymaker of claim 8, wherein the sensing arrangement further comprises a frame, wherein the plurality of sensors are coupled to the frame, and wherein the frame is structured to be coupled to a stripper bulkhead of the can bodymaker.

14. The can bodymaker of claim 8, wherein the controller is structured to determine adjustments to a position of a component of the can bodymaker responsive to the number of characteristics of the can body.

* * * * *